US010234229B2

(12) United States Patent
Lessard

(10) Patent No.: US 10,234,229 B2
(45) Date of Patent: Mar. 19, 2019

(54) MUZZLE END ACCESSORY MOUNT FOR A FIREARM

(71) Applicant: Sig Sauer, Inc., Newington, NH (US)

(72) Inventor: Ethan Lessard, East Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/991,545

(22) Filed: Jan. 8, 2016

(65) Prior Publication Data

US 2016/0202013 A1 Jul. 14, 2016

Related U.S. Application Data

(60) Provisional application No. 62/101,088, filed on Jan. 8, 2015.

(51) Int. Cl.
*F41A 21/32* (2006.01)

(52) U.S. Cl.
CPC ..... *F41A 21/325* (2013.01)

(58) Field of Classification Search
CPC ..... F41A 21/30; F41A 21/32; F41A 21/325; F41A 21/34; F41A 21/36; F41A 21/38; F41A 21/40; F41A 21/42
USPC ..... 89/14.2–14.4
See application file for complete search history.

(56) References Cited

U.S. PATENT DOCUMENTS 2,696,995 A * 12/1954 Schacht ..... F41A 21/325 285/392
3,187,633 A * 6/1965 Tanabe ..... F41A 21/36 89/14.3
3,202,056 A * 8/1965 Seeberger ..... F41A 21/325 89/14.3
4,510,843 A * 4/1985 Rabatin ..... F41A 21/325 89/14.4
4,893,426 A * 1/1990 Bixler ..... F16B 7/20 403/299
4,939,977 A * 7/1990 Stroup ..... F41A 21/30 89/14.4
5,433,133 A * 7/1995 La France ..... F41A 21/325 89/14.2
5,559,302 A * 9/1996 Latka ..... F41A 21/325 89/14.05
5,698,810 A * 12/1997 Rose ..... F41A 21/32 42/97
6,385,891 B1 * 5/2002 Rabatin ..... F41A 21/30 42/77
6,497,170 B1 12/2002 Kathe
(Continued)

*Primary Examiner* — Stephen Johnson
*Assistant Examiner* — Benjamin S Gomberg
(74) *Attorney, Agent, or Firm* — Finch & Maloney PLLC

(57) ABSTRACT

An accessory mount includes a barrel connector and multiple accessory connectors. The barrel connector removably assembles the accessory mount to the barrel of the firearm in axial alignment with the firing axis of the firearm. The accessory mount includes one or more of the accessory connectors to securely and removably assemble accessories to thereto. The accessory connectors include axial alignment features to axially align accessories with the firing axis and/or rotational alignment features to align the accessory alignment with the firing axis. Accessory connectors also include that enable an accessory to be securely assembled to the accessory mount in different rotational orientations.

22 Claims, 2 Drawing Sheets

(56) References Cited

U.S. PATENT DOCUMENTS

| | | | | |
|---|---|---|---|---|
| 7,832,323 | B1 * | 11/2010 | Davies | F41A 21/30 89/14.4 |
| 9,182,187 | B1 * | 11/2015 | Griffith | F41A 21/32 |
| 9,709,355 | B2 * | 7/2017 | Joplin | F41A 21/36 |
| 2011/0154711 | A1 | 6/2011 | Dickerson et al. | |

* cited by examiner

MUZZLE END ACCESSORY MOUNT FOR A FIREARM

RELATED APPLICATIONS

This application claims benefit of U.S. Provisional Application No. 62/101,088 filed Jan. 8, 2015, the contents of which are hereby incorporated by reference herein.

TECHNICAL FIELD

The present disclosure relates to accessories and accessory mounts for firearms, and particularly to muzzle end accessories and accessory mounts for rifles.

BACKGROUND

Muzzle end mounted firearm accessories are available for attachment to the barrel of firearms to accomplish various effects when the firearm is operated. Silencers are an example of such an accessory and include baffled chambers to slow the release of pressure from the barrel of the firearm. The slowed release of pressure reduces the audible report during firing. Flash hiders are another type of muzzle end accessory that include features to mix unburnt gunpowder and air in a manner that reduces the overall brightness of a flash that may occur during firing. Generally speaking, silencers and flash hiders may be mounted to the muzzle end of a firearm barrel in different rotational orientations without affecting the operation of the accessory.

Some muzzle end mounted accessories are designed for mounting to a firearm barrel in one or more particular rotational orientations to accomplish a desired effect. Muzzle brakes redirect a portion of combustion gases sideways or rearward, with respect to the firing direction, as the gases escape from a barrel when a shot is fired. As the gases are redirected, the firearm is pushed forward in a manner that counteracts recoil of the firearm. Muzzle brakes are typically mounted to a firearm barrel in a particular rotational orientation, such as to prevent gases from being redirected upward into the line of sight of the firearm operator. The manner of rotationally orienting a muzzle end accessory on the barrel is often referred to as timing the accessory to the barrel.

Compensators are another type of muzzle end accessory that is timed to one or more particular rotational orientations when mounted to a firearm barrel. Compensators redirect the flow of gasses that escape from a barrel during firing in an overall upward direction. The resulting force that acts against the firearm counteracts other forces that urge the muzzle end of a rifle upward during firing.

SUMMARY

According to an embodiment, a muzzle end accessory mount for a firearm is disclosed. The accessory mount includes an accessory mount body having a proximal portion and a distal portion. The accessory mount body defines a passageway between the proximal portion and the distal portion for passage of a bullet. A first accessory connector of the accessory mount body is constructed and arranged to removably connect with a first muzzle end accessory in axial alignment with a barrel of the firearm and in any of multiple rotational orientations about the firing axis of the firearm. A second accessory mount of the accessory mount body is constructed and arranged to removably connect with a second muzzle end accessory in axial alignment with the firing axis of the firearm.

According to another embodiment, a muzzle end accessory mount for a firearm is disclosed that includes an accessory mount body having a proximal portion and a distal portion. The accessory mount body defines a passageway between the proximal portion and the distal portion for passage of a bullet. A barrel connector is constructed and arranged to removably connect the proximal portion of the accessory mount body to a barrel of the firearm with the passageway in axial alignment with a firing axis of the firearm. The barrel connector includes threads and a conical surface that engage corresponding features of the barrel of the firearm. A first accessory connector of the accessory mount body is constructed and arranged to removably connect with a first muzzle end accessory in axial alignment with the barrel of the firearm. The first accessory connector is positioned at the distal portion of the accessory mount body and includes threads to engage corresponding threads of the first accessory. A compression element may be compressed between the first accessory and the first accessory connector to enable the first accessory to be rotationally aligned in a multiple rotational orientations about the firing axis of the firearm for the first accessory. A second accessory connector of the accessory mount body is positioned at least partially on a peripheral outer surface of the accessory mount body and about the accessory mount body at a larger diameter than the first connector. The second accessory connector is constructed and arranged to removably connect with a second muzzle end accessory in axial alignment with the firing axis of the firearm. The second accessory connector includes threads and a conical surface that engage corresponding features of the second accessory.

According to another embodiment, a method of assembling one or more muzzle end accessories to a firearm includes securing a first accessory to a first accessory connector of the accessory mount in any of multiple rotational positions about a firing axis of the firearm. The method also includes assembling a second accessory about the first accessory and to a second accessory connector of the accessory mount in axial alignment with the firing axis of the firearm.

The subject matter of this application may involve, in some cases, interrelated products, alternative solutions to a particular problem, and/or a plurality of different uses of a single system or article.

The present disclosure is not intended to be limited to a system or method that must satisfy one or more of any stated objects or features. Modifications and substitutions by one of ordinary skill in the art are considered to be within the scope of the present disclosure.

BRIEF DESCRIPTION OF THE FIGURES

In the drawings, different embodiments of the invention are illustrated in which.

DETAILED DESCRIPTION

Various muzzle end accessories including silencers, flash hiders, muzzle brakes and compensators, among others, may be assembled to the barrel of a firearm to alter firing characteristics as desired by an operator. Operating performance of different types of muzzle end accessories may depend on how well the accessory is aligned with the firearm, either axially with the firing axis and/or rotationally about the firing axis. Operators may desire to use multiple types of muzzle end accessories with a particular firearm, either alternately or in combination, under different firing conditions.

According to one example embodiment, an accessory includes a barrel connector and multiple accessory connectors. The barrel connector may be used to securely and removably assemble the accessory mount to the barrel of the firearm in axial alignment with the firing axis of the firearm. One or more of the accessory connectors may securely and removably assemble accessories to the firearm via the accessory mount and in axial alignment with the firing axis. Accessory connectors may include rotational alignment features that enable an accessory to be securely assembled to the accessory mount in different rotational orientations. In this respect, accessories designed to operate in particular rotational orientations may be rotationally aligned or timed about the firing axis, regardless of the rotational orientation between the accessory mount and the barrel.

Figure 1:
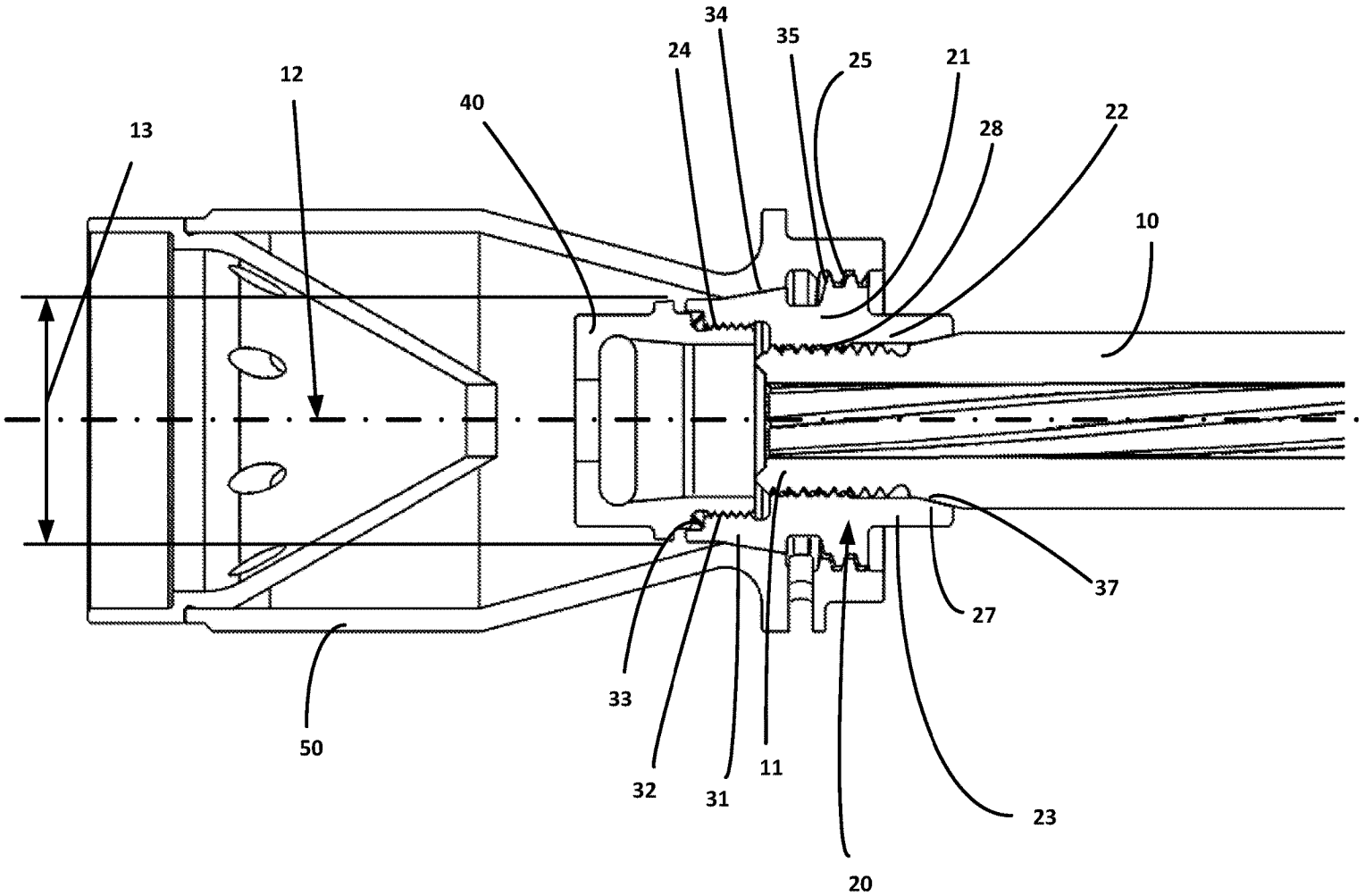
FIG. 1 is a cross sectional view taken along the firing line of a firearm and shows a muzzle end of a firearm barrel, an accessory mount, a compensator connected to the accessory mount, and a silencer connected to the accessory mount, according to an embodiment of the disclosure.

Turn now to the Figures, and initially FIG. 1 that shows a cross-sectional view of a muzzle end 11 of firearm barrel 10. As shown, an accessory mount 20 is connected to the muzzle end 11 of the firearm barrel 10 and provides multiple connectors for different muzzle end firearm accessories. The accessory mount includes a body 21 that defines a passageway that lies along the firing axis 12 of the firearm and through which the bullet may pass, when issued from the firearm. A barrel connector 22 is provided at proximal portion 23 of the accessory mount body 21 for removably connecting the accessory mount 20 to the barrel 10 of the firearm. The accessory mount 20 also includes a first accessory connector 24 and a second accessory connector 25 that, respectively, receive first 40 and second 50 accessories. The first accessory connector 24 is located a distal portion 31 of the accessory mount body 21 and the second accessory connector 25 is located about a peripheral, outer surface of the accessory mount body 21.

Figure 2:
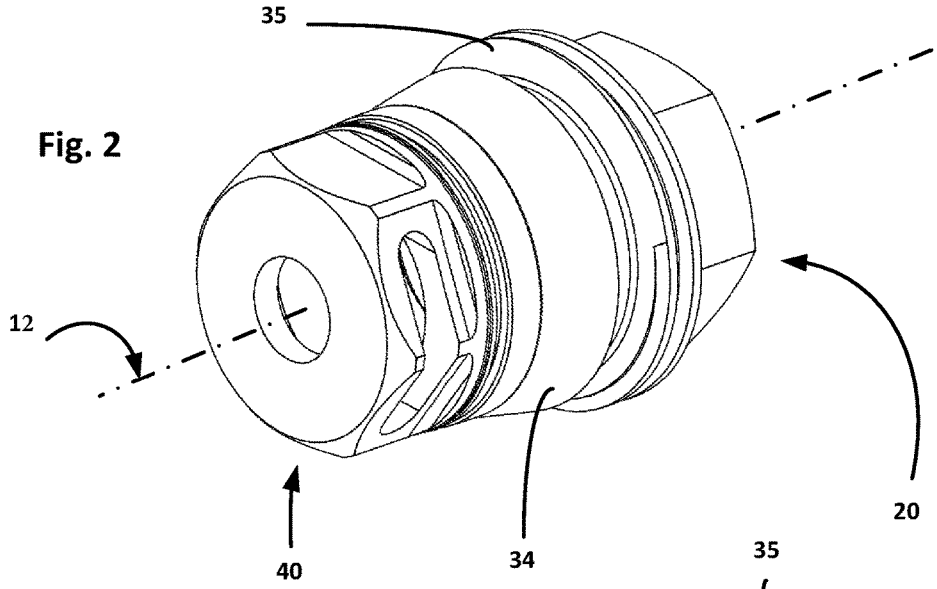
FIG. 2 is a perspective view of a muzzle end accessory mount with a compensator connected thereto, according to an embodiment of the present disclosure.

The barrel connector 22 includes alignment features 27 that mutually engage corresponding features on the firearm barrel 10 and that axially the mount to the barrel. In the example embodiment of FIG. 1, the alignment features include a radially inward facing conical surface that receives a corresponding radially outward facing conical surface of the firearm. Internal threads 28 of the accessory mount 20 receive corresponding threads of the barrel. To install the accessory mount on the firearm, the threads of the firearm are brought into engagement with the threads of the accessory mount 20. The inward facing conical surface of the barrel connector 22 is brought into engagement with the outwardly facing conical surface of the barrel as the accessory mount is rotated relative to the barrel. The accessory mount 20 is axially centered with respect to a firing axis 12 of the firearm barrel through the interaction between the inwardly conical surface 27 and the outwardly facing conical surface 37. Frictional interaction between the conical surfaces may additionally promote a secure connection between the accessory mount 20 and barrel 10. The accessory mount 20 may be removed from the barrel 10 by rotating the mount relative to the barrel in an opposite direction. It is to be appreciated that the barrel connection and alignment features described herein with respect to the embodiment shown in FIGS. 1 and 2 are merely examples, and that alternate connectors and/or alignment features are contemplated. It is also to be appreciated that not all embodiments include a barrel connector and may alternately be integral with or non removably connected to a firearm barrel, according to some embodiments.

Figure 3:
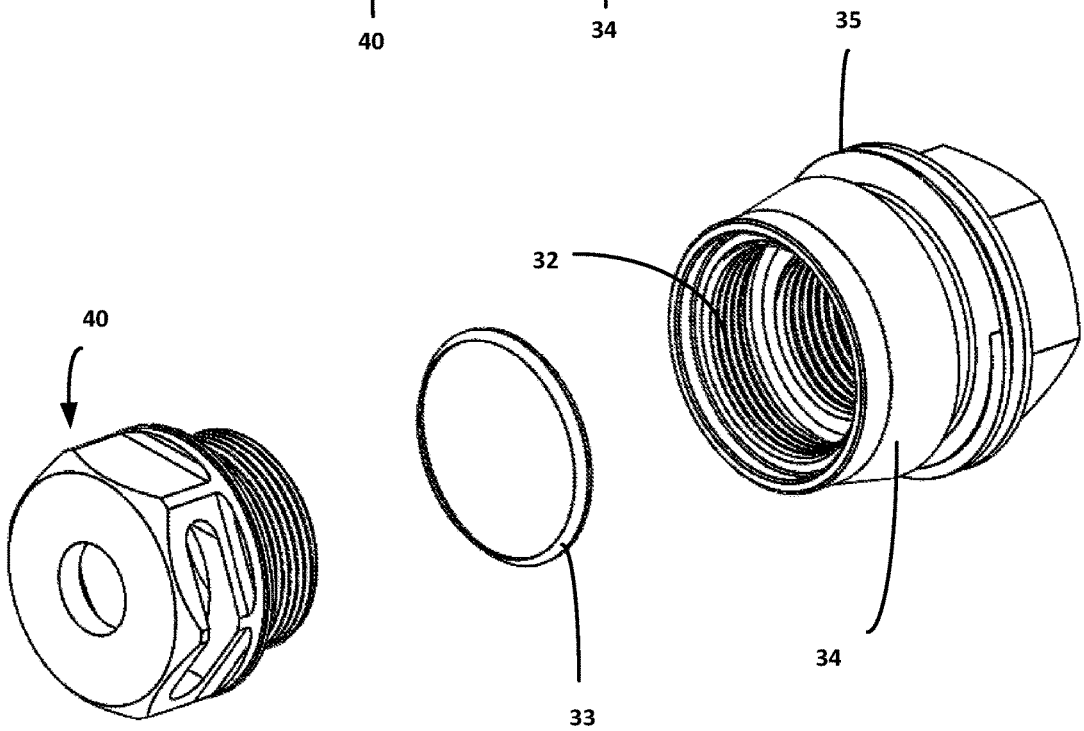
FIG. 3 is an exploded perspective view of the embodiment shown in FIG. 2, and separately shows a compensator, a compression element, and an accessory mount, according to an embodiment of the present disclosure.

The cross sectional view of FIG. 1 shows a compensator 40, as also shown in FIGS. 2 and 3, mounted to a first accessory connector at the distal portion 31 of the accessory mount 20. The first connector 24 includes threads 32 that receive complimentary threads of the compensator 40. Axial alignment between the first accessory 40 and the accessory mount 20, and thus the firearm barrel 10, may be provided by engagement between the threads 32 of the first connector and 40 first accessory. According to some embodiments, conical alignment surface and/or other types of alignment features may be included, either in addition to or in place of alignment provided by the threaded connection. In the example embodiment of FIGS. 1-3 the first connector is constructed such that at least a portion of the first accessory, when mounted to the barrel, lies flush with the distal end of the barrel, although other constructions are also possible.

Connectors of the accessory mount may include features that provide adjustable rotational alignment or "timing" between accessories and the firearm barrel. As may be seen in FIGS. 1 and 2, a compression element 33 is positioned between the compensator (first accessory) and the accessory mount body 21. The compression element 33 is compressed between the compensator 40 and mount body 21 when the compensator when is assembled to the accessory mount. Forces associated with the compression element, which can be a crush washer as illustrated, resist compression and promote secure engagement between threads of the first connector and compensator, preventing unintentional removal of the compensator. The pitch of the threads of the first connector and the resilience of the compression element may be selected such that a range of forces associated with compressing the compression element is adequate to securely position the first accessory in multiple rotational orientations, including orientations that span up to and greater than 360 degrees. In this respect, a compensator or other type of accessory may be mounted to a firearm through the accessory mount in different rotational positions or "timing" positions.

The second connector 25 of the accessory mount is constructed to receive a second accessory 50 over the first accessory 40 and first connector 24. As shown in FIG. 1, the second connector lies on an outer peripheral surface of the accessory mount body at a diameter 13 that is greater than that of the distal portion 31 of the mount body 21 and first accessory 40. Such a configuration allows the second accessory 50, which is a silencer in the illustrated embodiment of FIG. 1, to be installed and removed from the accessory mount 20 while the first accessory 40 is also assembled to the accessory mount 20. Such a configuration enables a firearm to be operated in any of multiple configurations, including configurations with accessories mounted to one of the first and second accessory connectors and not the other, or with accessories mounted to both of the first and second accessory connectors.

The second connector includes threads 35 and a radially outward facing conical surface 34 that engage corresponding threads of a radially inward facing conical surface of the second accessory 50 in a manner similar to that discussed herein with respect to the barrel connector. Threads of the second connector engage corresponding threads of the silencer (or other type of second accessory). As the threads are tightened, engagement between the conical surfaces urges the silencer into axial alignment as the silencer is secured to the accessory mount and firearm.

As is to be appreciated, connectors of accessory mounts, according to the present disclosure, may include different types of axial and/or rotational alignment features depending on the type of muzzle end accessory that is to be used with a particular connector. By way of example, silencers and suppressors may perform optimally when aligned more precisely with the firing axis of a firearm. Performance for other types of accessories, such as muzzle brakes, flash hiders, and suppressors may be impacted less by axial misalignments and more so by rotational misalignments. Conical alignment surface may promote a more precise and/or accurate axial alignment than other types of connectors, such as threads without conical engagement surfaces, as with the first connector illustrated in the example embodiment of FIGS. 1-3. Rotationally adjustable connectors, such as connectors that include a crush washer as discussed herein, may prove more suitable for use with accessories that operate optimally when installed in one or more particular rotational orientations.

In use, an operator may initially assemble the accessory mount embodiment of FIGS. 1-3 to a firearm by threading the barrel connector onto mating threads at the muzzle end of the firearm barrel. As the accessory mount is secured to the barrel, engagement between the conical surface of the barrel connector and barrel urge the accessory mount into axial alignment with the firing axis of the firearm. Frictional engagement between the threads and/or conical surfaces prevents unintended disassembly of the accessory mount from the firearm. The accessory mount may be positioned in any rotationally alignment about the firing axis of the firearm, provided that there is adequate resistance to unintentional disassembly.

A first accessory may be assembled to the first connector of the accessory mount before the accessory mount is assembled to the firearm, as shown in FIG. 2, or after the accessory mount is assembled to the firearm. Any accessory that is connected to the first connector and that is intended to operate in a particular rotational alignment may be rotationally timed and fastened to the accessory mount after the accessory mount is secured to the firearm. In this respect, any changes in rotational alignment of the accessory mount that occur when the accessory mount is assembled to the firearm may be compensated for by adjusting the rotational alignment of the first accessory with respect to the accessory mount. Once the first accessory is timed as desired by an operator, another accessory may be assembled to the second accessory connector of the accessory mount. This may be accomplished by positioning the second accessory (a silencer in the example embodiment of FIG. 1) over any first accessory that is connected to the accessory mount and securing the second accessory to the mount with the second accessory connector.

It is to be appreciated that a firearm may be operated with or without a first and/or a second accessory assembled to the firearm by an assembly mount. By way of example, according to some approaches, an operator may fire a firearm with a compensator assembled to the first connector of an assembly mount and without any accessories assembled to a second mount. Alternately an operator may operate a firearm with an accessory, such as a silencer, assembled to the firearm via the second connector of an accessory mount. The operator may, additionally or alternately, use the firearm without accessories mounted at either of the first or second connectors of the accessory mount.

While several embodiments have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of this disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of this disclosure is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, along with other embodiments that may not be specifically described and claimed.

All definitions, as defined herein either explicitly or implicitly through use should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A muzzle end accessory mount for a firearm, the accessory mount comprising:

a proximal portion and a distal portion, the proximal and distal portions defining a passageway for passage of a bullet;

a barrel connector internally threaded and having a first diameter;

a first accessory connector constructed and arranged to removably connect with a first accessory in axial alignment with a barrel of the firearm and in a plurality of rotational orientations about a firing axis of the firearm, wherein said first accessory connector includes internal threads and has a second diameter larger than the first diameter to engage corresponding threads of the first accessory; and a second accessory connector constructed and arranged to removably connect with a second accessory in axial alignment with the firing axis of the firearm, said second accessory connector includes threads to engage corresponding threads of the second accessory.

2. The muzzle end accessory mount of claim 1, wherein said first accessory connector is positioned at said distal portion.

3. The muzzle end accessory mount of claim 1, further comprising a compression element that is compressed between the first accessory and said first accessory connector to provide the plurality of rotational orientations about the firing axis of the firearm for the first accessory.

4. The muzzle end accessory mount of claim 3, wherein the compression element is a crush washer.

5. The muzzle end accessory mount of claim 3, in combination with the first accessory.

6. The muzzle end accessory mount of claim 3, in combination with the first accessory, wherein said first accessory is selected from the group consisting of a compensator and a muzzle brake.

7. The muzzle end accessory mount of claim 1, wherein said second accessory connector is positioned at least partially between said first accessory connector and said proximal portion.

8. The muzzle end accessory mount of claim 1, wherein said second accessory connector is positioned at least partially on a peripheral outer surface of said accessory mount.

9. The muzzle end accessory mount of claim 8, wherein said second accessory connector is positioned at a radial distance from the firing axis that is larger than said first accessory connector.

10. The muzzle end accessory mount of claim 1, in combination with the second accessory.

11. The muzzle end accessory mount of claim 1, in combination with the second accessory, wherein said second accessory includes a silencer.

12. The muzzle end accessory mount of claim 1, wherein said internally threaded barrel connector is constructed and arranged to removably connect said proximal portion to the barrel of the firearm with said passageway in axial alignment with the firing axis of the firearm.

13. The muzzle end accessory mount of claim 1, wherein said internally threaded barrel connector includes an inner conical surface configured to engage features of the barrel of the firearm.

14. The muzzle end accessory mount of claim 1, in combination with the firearm.

15. The muzzle end accessory mount of claim 1, wherein said accessory mount has an inner surface defining the passageway, and wherein said first accessory is positioned on said inner surface.

16. The muzzle end accessory mount of claim 1, wherein the first accessory connector is constructed and arranged such that at least a portion of the first accessory, when mounted to the barrel, lies flush with a distal end of the barrel.

17. The muzzle end accessory mount of claim 1, wherein the first diameter is positioned at the proximal portion and the second diameter is positioned at the distal portion of the accessory mount.

18. The muzzle end accessory mount of claim 1, wherein the distal portion has an outer peripheral surface that is spaced apart from said first accessory connector and said second accessory connector.

19. A muzzle end accessory mount for a firearm, the accessory mount comprising:

a proximal portion and a distal portion, the proximal and the distal portions defining a passageway for passage of a bullet, the accessory mount having an outer peripheral surface, and an inner surface defining the passageway;

a barrel connector internally threaded and having a first diameter;

a first accessory connector constructed and arranged to removably connect with a first accessory in axial alignment with a barrel of the firearm and in a plurality of rotational orientations about a firing axis of the firearm, wherein said first accessory connector includes internal threads and has a second diameter larger than the first diameter to engage corresponding threads of the first accessory; and a second accessory connector constructed and arranged to removably connect with a second accessory in axial alignment with the firing axis of the firearm, wherein said second accessory connector is positioned on said outer peripheral surface.

20. The muzzle end accessory mount of claim 19, wherein the outer peripheral surface includes a conical surface configured to engage the second accessory.

21. The muzzle end accessory mount of claim 20, wherein the conical surface is aligned with the first accessory connector.

22. The muzzle end accessory mount of claim 19, wherein the first accessory connector is constructed and arranged such that at least a portion of the first accessory, when mounted to the barrel, lies flush with a distal end of the barrel.

* * * * *